US007669514B2

(12) United States Patent
Urbanczyk

(10) Patent No.: US 7,669,514 B2
(45) Date of Patent: Mar. 2, 2010

(54) DEVICE TO GUARANTEE THE SEQUENCE OF MOVEMENT OF AT LEAST TWO FLUID-ACTUATED DISPLACEMENT UNITS

(75) Inventor: Nikos Urbanczyk, Mömlingen (DE)

(73) Assignee: Linde Material Handling GmbH, Aschaffenburg (DE)

( * ) Notice: Subject to any disclaimer, the term of this patent is extended or adjusted under 35 U.S.C. 154(b) by 469 days.

(21) Appl. No.: 11/591,182

(22) Filed: Nov. 1, 2006

(65) Prior Publication Data

US 2007/0101856 A1 May 10, 2007

(30) Foreign Application Priority Data

Nov. 2, 2005 (DE) ..... 10 2005 052 116

(51) Int. Cl.
*F01L 15/00* (2006.01)

(52) U.S. Cl. ..... 91/189 A

(58) Field of Classification Search ..... 91/189 A
See application file for complete search history.

(56) References Cited

U.S. PATENT DOCUMENTS 3,956,970 A * 5/1976 Kupiek et al. ..... 91/189 A
4,365,374 A * 12/1982 Bennett ..... 91/189 A
5,355,769 A * 10/1994 Kottke ..... 91/189 A

FOREIGN PATENT DOCUMENTS

DE 101 25 351 A1 11/2002

* cited by examiner

*Primary Examiner*—F. Daniel Lopez
(74) *Attorney, Agent, or Firm*—The Webb Law Firm

(57) ABSTRACT

A device to guarantee the sequence of movement of at least two fluid-actuated displacement units. A primary displacement unit includes a cylinder (Z) with a retractable and extendable piston rod (4). Integrated into the cylinder (Z) is a directional control valve that can be controlled by the piston rod (4). The directional control valve has a closed position and an open position. The directional control valve is switched into the closed position when the piston rod (4) is not fully extended or not approximately fully extended, and into the open position when the piston rod is fully or approximately fully extended, and a compression chamber (1*a*) of the cylinder (Z) is thereby placed in communication with a compression chamber of the secondary displacement unit (secondary cylinder 2*b*).

4 Claims, 12 Drawing Sheets

DEVICE TO GUARANTEE THE SEQUENCE OF MOVEMENT OF AT LEAST TWO FLUID-ACTUATED DISPLACEMENT UNITS

CROSS REFERENCE TO RELATED APPLICATION

This application claims priority to German Application No. 10 2005 052 116.9, filed Nov. 2, 2005, which application is herein incorporated by reference in its entirety.

BACKGROUND OF THE INVENTION

1. Field of the Invention

This invention relates to a device to guarantee the sequence of movement of at least two fluid-actuated displacement units, with a primary displacement unit moved chronologically before a secondary displacement unit, and with the primary displacement unit in the form of a cylinder having a retractable and extendable piston rod.

2. Technical Considerations

A device of the known art is described in DE 101 25 351 A1 and is provided in that case for use in lifting masts of industrial trucks (e.g., fork-lift trucks).

In lifting masts of this type, a primary lifting cylinder in the form of a plunger piston cylinder that is initially extended is connected with load holding means, such as a fork carrier. A secondary lifting cylinder (or two secondary lifting cylinders) that is also in the form of a plunger piston cylinder that is extended after the primary lifting cylinder is engaged on a mast that can be moved vertically and is guided in a stationary mast. The sequence in which the piston rods of the primary and secondary lifting cylinders are extended is determined by the piston surface area, with the primary lifting cylinder being extended first on account of its larger piston surface. Only when the piston rod of the primary lifting cylinder has been fully extended or comes in contact against a limit stop does the piston rod of the secondary lifting cylinder begin to be extended as a result of the increase in the system pressure.

On account of the different piston surface areas of the lifting cylinders, the lifting speeds are different, which can be avoided by the use of lifting cylinders that have equal areas. In this case, the sequence of extensions is determined exclusively by the dead weight of the components to be lifted by the lifting cylinders.

Regardless of the relationship between the piston surface areas, it can occur under unfavorable conditions, in particular at low oil temperatures, that the piston rod of the secondary lifting cylinder is extended first. This reversal of the desired sequence of movement can also occur when the lifting frame is retracted. Although, in that case, the situation is considered less critical.

In one exemplary embodiment described in DE 101 25 351 A1, two secondary lifting cylinders are connected in parallel to a pressure medium source and a primary lifting cylinder is connected in series downstream of one of the secondary lifting cylinders. Upstream of the other secondary lifting cylinder is a stop valve that opens as a function of the pressure. As a result of which, the pressure difference between the primary lifting cylinder and the second secondary lifting cylinder is increased and a reversal of the desired sequence of movement is prevented.

Therefore, it is an object of this invention to provide a device of the general type described above but that has a simplified construction.

SUMMARY OF THE INVENTION

The invention teaches that a directional control valve is integrated into the cylinder that can be controlled by the piston rod and has a closed position and an open position. It is switched into the closed position when the piston rod is not fully extended or substantially not fully extended, and is switched into the open position when the piston rod is fully extended or substantially fully extended. A compression chamber of the cylinder is thereby selectively placed in communication with a compression chamber of the secondary displacement unit.

A teaching of the invention is accordingly to control the downstream components via the position of the piston rod of the cylinder. No additional (electrical, electronic or mechanical) sensors or actuators are necessary but only a mechanically controlled directional control valve is provided and is integrated into the cylinder.

The secondary displacement unit is thereby placed in communication with the pressure medium supply only when a defined extended position of the piston rod of the primary displacement unit that is realized in the form of a cylinder is reached so that the correct sequence of movement is guaranteed.

In one advantageous configuration of the invention, the cylinder has a cylinder head that guides the piston rod, and the directional control valve is provided in the vicinity of the cylinder head with a sleeve-shaped pilot valve that concentrically surrounds the piston rod. The pilot valve interacts with a lateral control opening. When the piston rod is extended, the pilot valve can be moved axially by a driver device (e.g., located on the end of the piston rod inside the cylinder) against the spring force from a closed position that blocks the control opening into an open position that exposes the control opening. In this embodiment, the directional control valve integrated into the cylinder therefore comprises the sleeve-shaped pilot valve that is actuated by the piston rod and the cylinder-side control opening that interacts with it.

The pilot valve is preferably provided with transverse borings that are in communication radially inwardly with the compression chamber of the cylinder and can be brought into communication radially outwardly with the control opening by axial displacement of the pilot valve.

In another no less advantageous configuration of the invention, the cylinder has a cylinder head that guides the piston rod, and the directional control valve is provided with at least one control passage that is machined into the piston rod. The control passage can be brought into communication during the extension of the piston rod with a lateral control opening that is located in the vicinity of the cylinder head. The construction of the device of the invention is simplified compared to a realization with a control sleeve. The directional control valve that is integrated into the cylinder therefore includes a segment of the piston rod that contains the control passage and the cylinder-side control opening that interacts with it. The piston rod is thereby a part of the directional control valve.

If the control opening is located in the area of the cylinder head that guides the piston rod, on account of the ability to provide a seat at that point between the cylinder head and the piston rod, a good seal of the control opening is achieved in those operating positions of the piston rod in which the control passage is not aligned with the lateral control opening.

With regard to the feed of hydraulic fluid into the cylinder, in one development of the invention the cylinder can have a cylinder bottom that is provided with an inlet opening that is in direct communication with the compression chamber of the cylinder.

It is also possible, however, for the piston rod to be provided on the end surface farther from the cylinder with an inlet opening that is in communication via an axial boring with the compression chamber of the cylinder.

Finally, a construction can also be used in which an inlet opening is integrated into the cylinder head.

In all of the variants described above, it is advantageous if, between the compression chamber of the cylinder and the compression chamber of the secondary displacement unit, a bypass valve is connected in the circuit. The bypass valve can include a check valve that is parallel to the directional control valve and closes the compression chamber of the secondary displacement unit. Thus, when hydraulic fluid is discharged from the displacement units, regardless of the position of the piston rod of the primary displacement unit that is realized in the form of a cylinder, hydraulic fluid first flows back out of the secondary displacement unit, bypassing the directional control valve.

The bypass valve can be advantageously integrated into the cylinder head.

In one development of the invention, the control opening can be realized in the form of an annular passage adjacent to a radial boring. This design makes it possible to achieve accurate and precise functioning of the directional control valve.

The device of the invention to guarantee the sequence of movement can basically be used in all hydraulic and pneumatic actuator cylinder systems in which downstream secondary cylinders are to be influenced only when the extended position of a primary cylinder is reached. However, special preference is given to the use of the device of the invention in at least one hydraulic lifting cylinder of a multi-stage lifting mast of an industrial truck.

BRIEF DESCRIPTION OF THE DRAWINGS

Additional advantages and details of the invention are explained in greater detail below on the basis of the exemplary embodiment illustrated in the accompanying schematic figures, in which like reference numbers identify like parts throughout.

DESCRIPTION OF THE PREFERRED EMBODIMENTS

In the illustrated exemplary embodiment, the device of the invention to guarantee the sequence of movement is provided for use in a lifting mast of an industrial truck. In this case, a primary cylinder 1, which is coupled by way of example with a fork carrier, is extended and retracted chronologically before two secondary cylinders 2*a*, 2*b*. The secondary cylinders 2*a* and 2*b* actuate the telescoping portion of the mast (inner mast) that can be extended from a stationary portion of the mast (outer mast) which is firmly fastened to the frame. The primary cylinder 1 plus the fork carrier are fastened to the telescoping portion of the mast. In the illustrated exemplary embodiment, the primary cylinder 1 is connected in series between the two secondary cylinders 2*a* and 2*b*.

Hydraulic fluid delivered from a common pressure medium source flows first into the first secondary cylinder 2*a*, through the latter to the primary cylinder 1, and then to the second secondary cylinder 2*b*. A check valve R ensures that during the discharge of the hydraulic fluid, the two secondary cylinders 2*a* and 2*b* retract before the primary cylinder 1 retracts.

Figure 2:
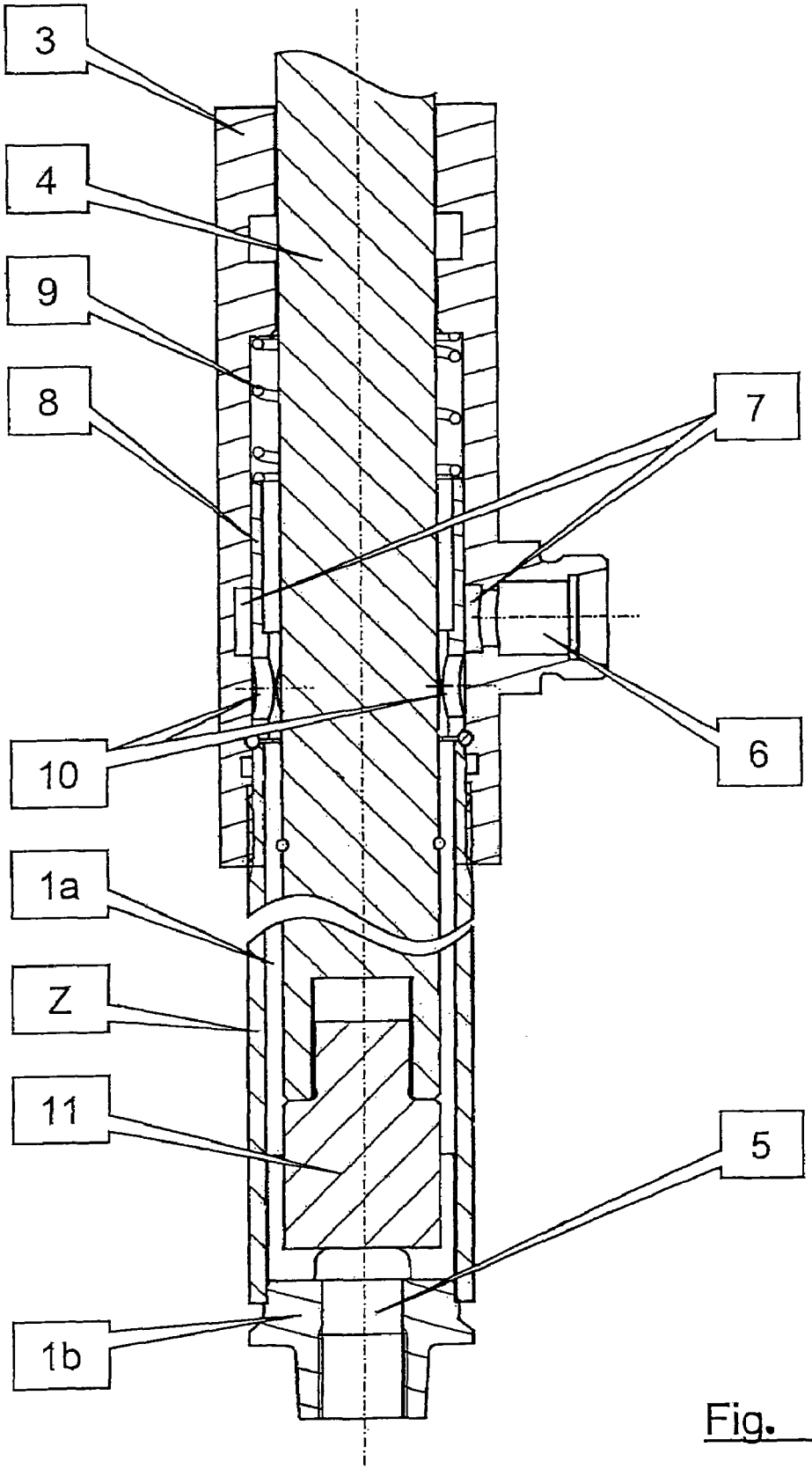
FIG. 2 is a section through a cylinder of a device of the invention.
Figure 3:
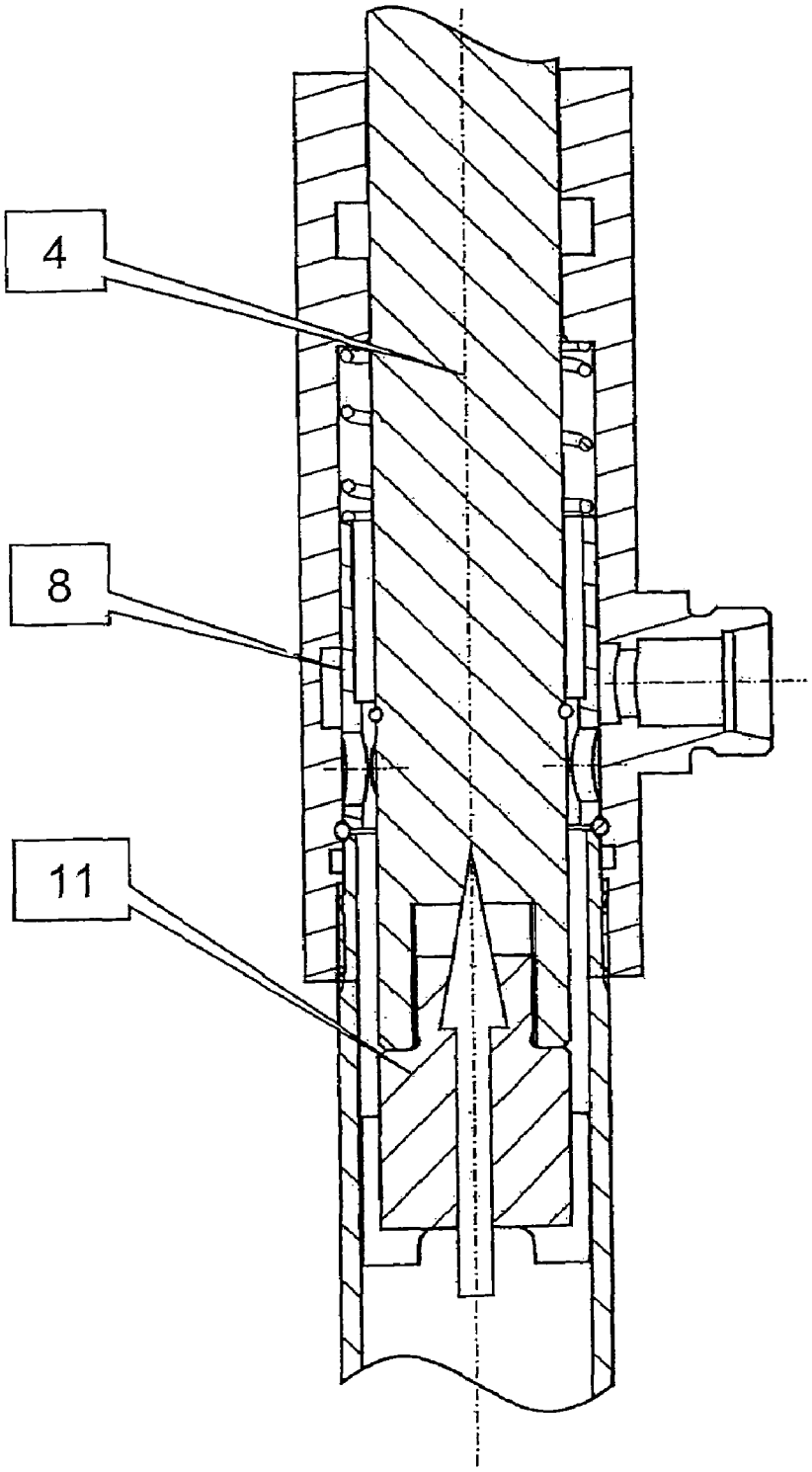
FIG. 3 shows the cylinder in FIG. 2 during the extension of the piston rod.
Figure 4:
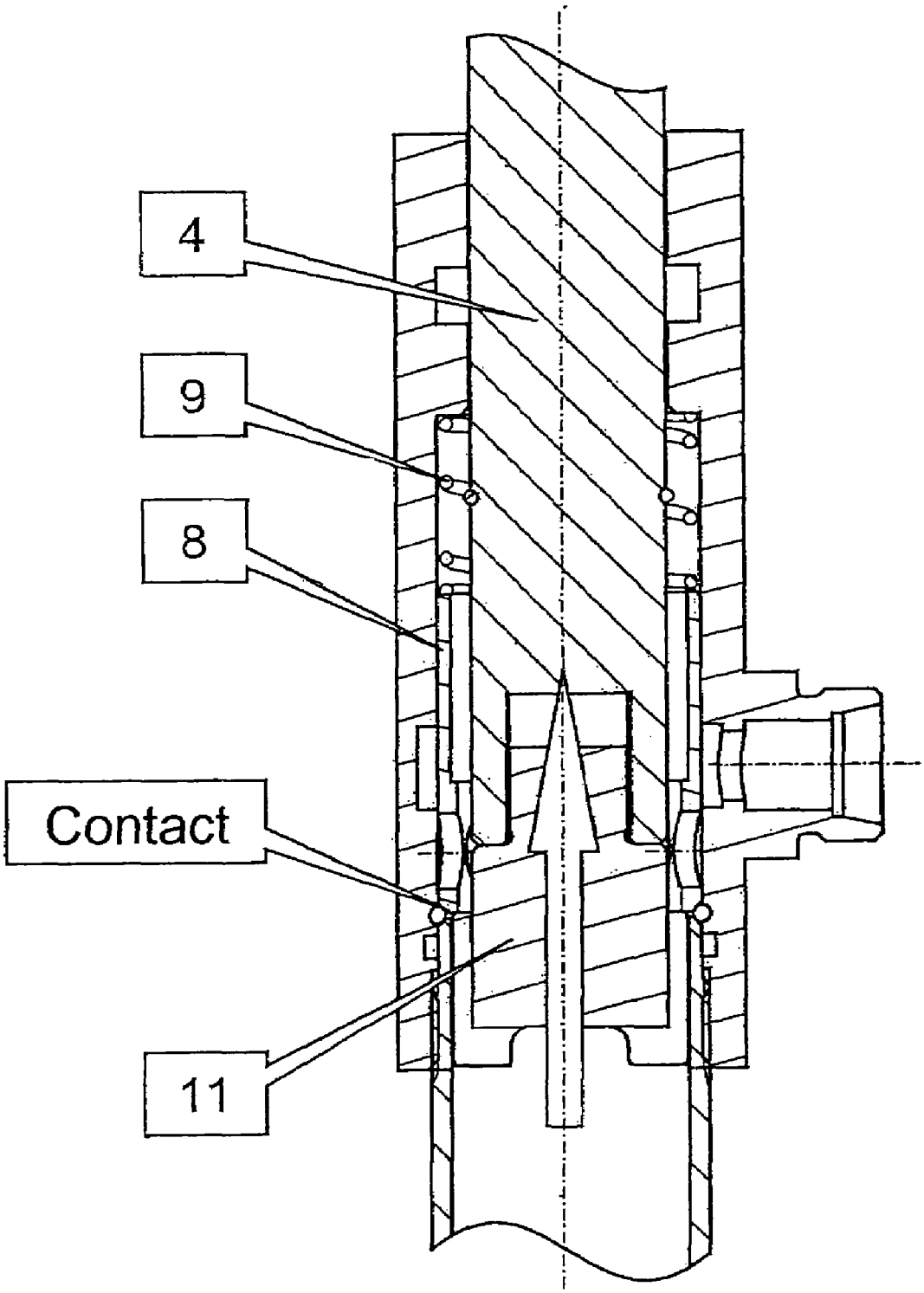
FIG. 4 shows the cylinder in FIG. 2 during the activation of the pilot valve.

FIGS. 2 to 4 show a cylinder Z representing the primary cylinder 1 in the form of a plunger piston cylinder (plunger cylinder). This cylinder Z has a compression chamber 1*a* from which a piston rod 4 can be extended in a sealed manner through a cylinder head 3. The extension is effected by a pressure medium that can flow in through an inlet opening 5 in a cylinder bottom 1*b*.

The cylinder head 3 is provided with a lateral outlet opening 6, through which the compression chamber 1*a* of the cylinder Z can be placed in communication with a compression chamber of the secondary cylinder 2*b*. It is also conceivable, depending on the configuration of the cylinder head 3, that the outlet opening 6 can be located not directly in the cylinder head 3 but immediately underneath it. The outlet opening 6 is in the form of a radial boring adjacent to an annular passage in the cylinder head 3 that acts as a control opening 7. In this area, there is a sleeve-shaped pilot valve 8 that concentrically surrounds the piston rod 4 and can be pressed by a spring (compression spring 9) toward the cylinder bottom 1*b*. The pilot valve 8, together with the control opening 7, forms a directional control valve that is integrated into the cylinder Z.

The pilot valve 8 is provided with transverse borings 10 which are in communication radially inwardly with the compression chamber 1*a* of the cylinder 1. Radially outwardly, the transverse borings 10 are in contact against the internal cylindrical surface of the cylinder head 3. In this position, the pilot valve 8 blocks the control opening 7.

Hydraulic fluid under pressure that flows in through the inlet opening 5 in the cylinder bottom 1*b* into the compression chamber 1*a* causes the piston rod 4 to extend from the cylinder Z (FIG. 3). In this case, the control opening 7 initially remains blocked so that the hydraulic medium cannot continue to flow into the control opening 7 and, thus, not into the outlet opening 6 and the secondary cylinder 2*b*.

As the piston rod 4 extends farther, the piston rod bottom (which acts as a driver device 11 for the pilot valve 8 and is located on the end of the piston rod 4 inside the cylinder) comes into engagement with the pilot valve 8 (see FIG. 4: "Contact") shortly before it reaches the maximum stroke of the piston rod 4 and displaces the latter against a spring force so that the control opening 7 is exposed (see also FIG. 5). Pressure medium can, therefore, also flow through the outlet opening 6 to the secondary cylinder 2*b* so that its piston rod can be placed in motion.

Figure 5:
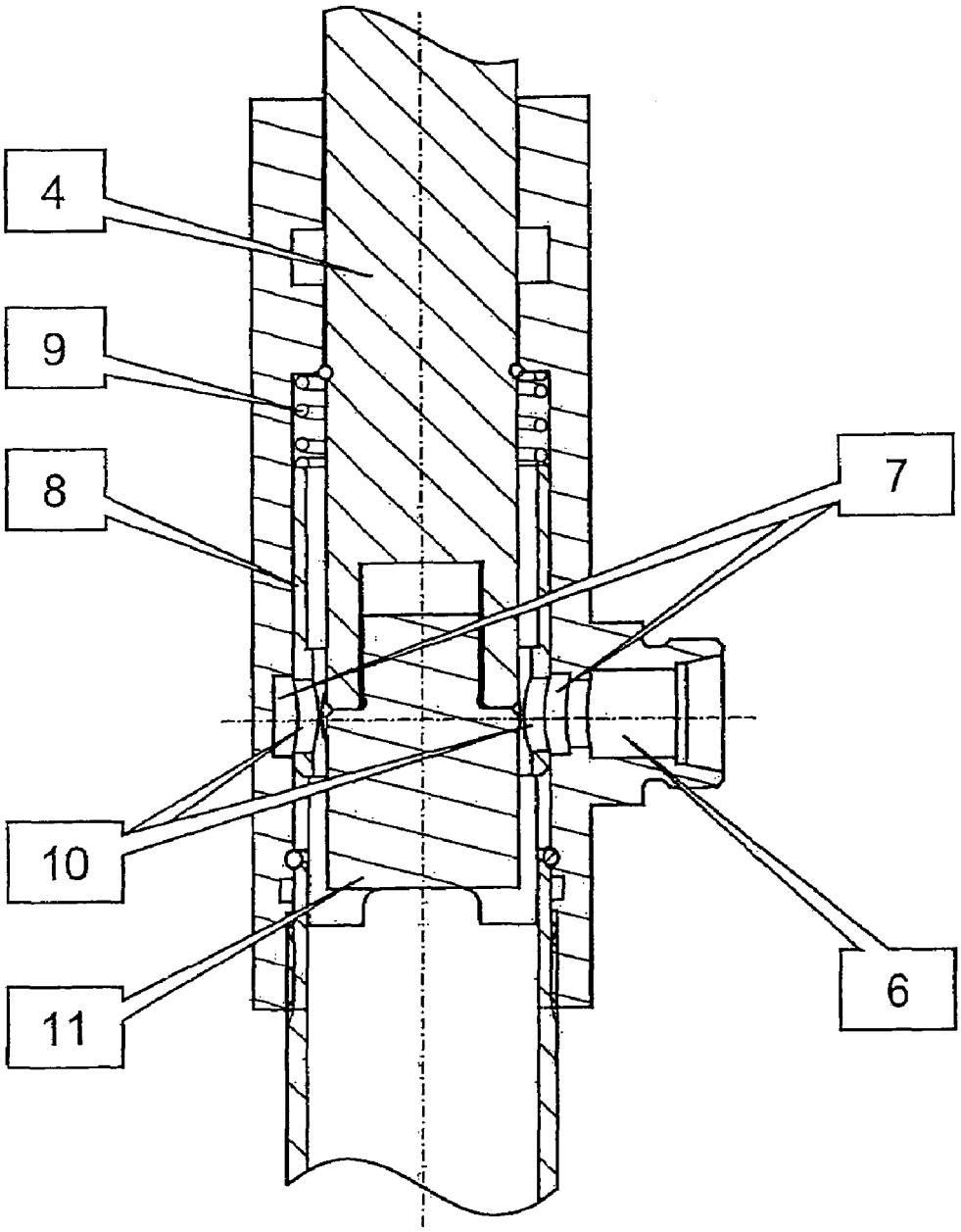
FIG. 5 shows the cylinder in FIG. 2 with the fully extended piston rod.

In the position of the piston rod 4 illustrated in FIG. 5, the piston rod 4 is extended as far as possible out of the cylinder Z, whereby the pilot valve 8 is in its limit position and the control opening 7 is fully exposed.

Figure 6:
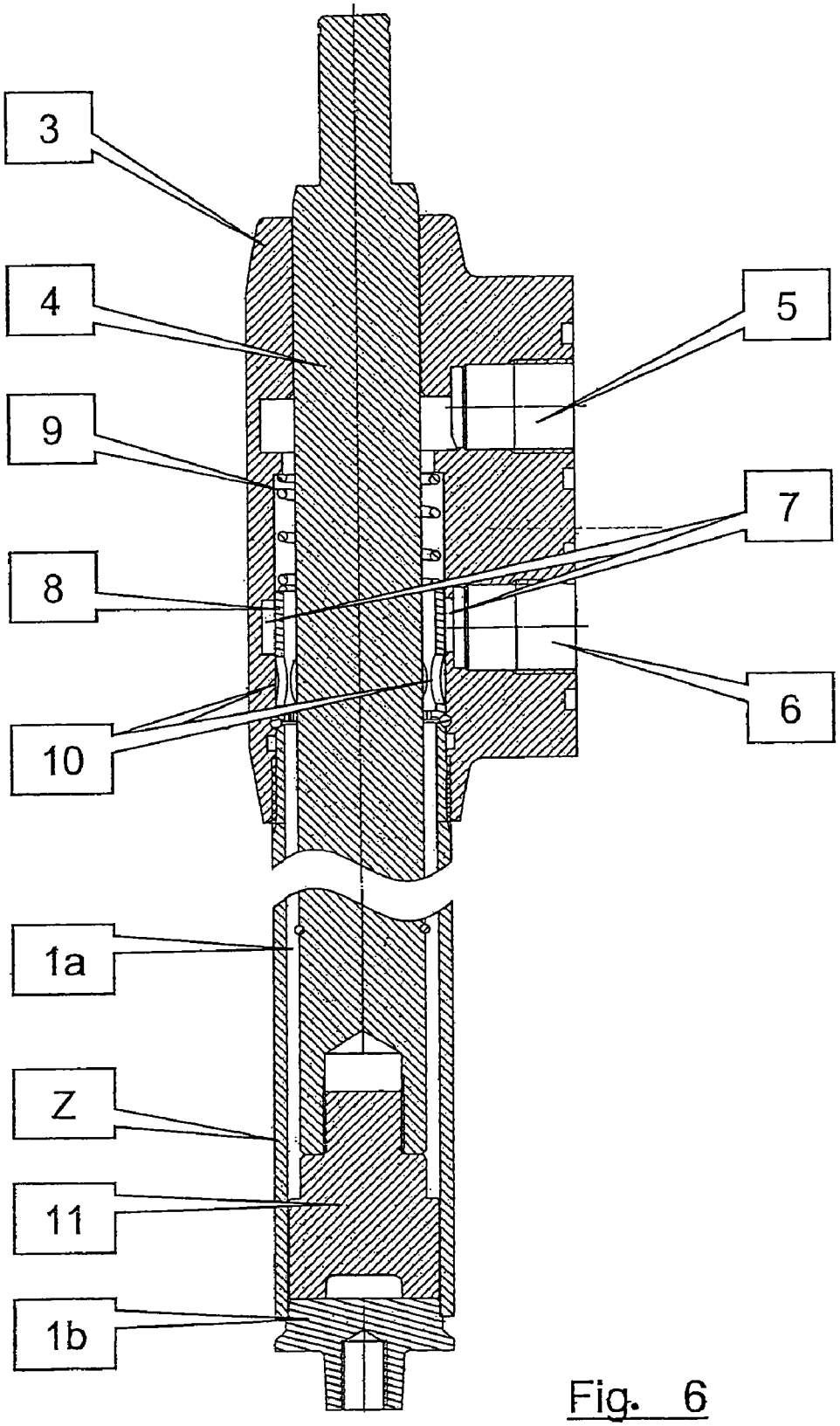
FIG. 6 is a section through a cylinder of a variant of a device of the invention.

FIG. 6 shows a variant in which the feed of hydraulic fluid does not take place through the cylinder bottom 1*b* of the cylinder Z but, rather, on the cylinder head side. In this case, the inlet opening 5, which is realized in the form of a radial boring, is integrated into the cylinder head 3 and is located above the outlet opening 6.

Figure 7:
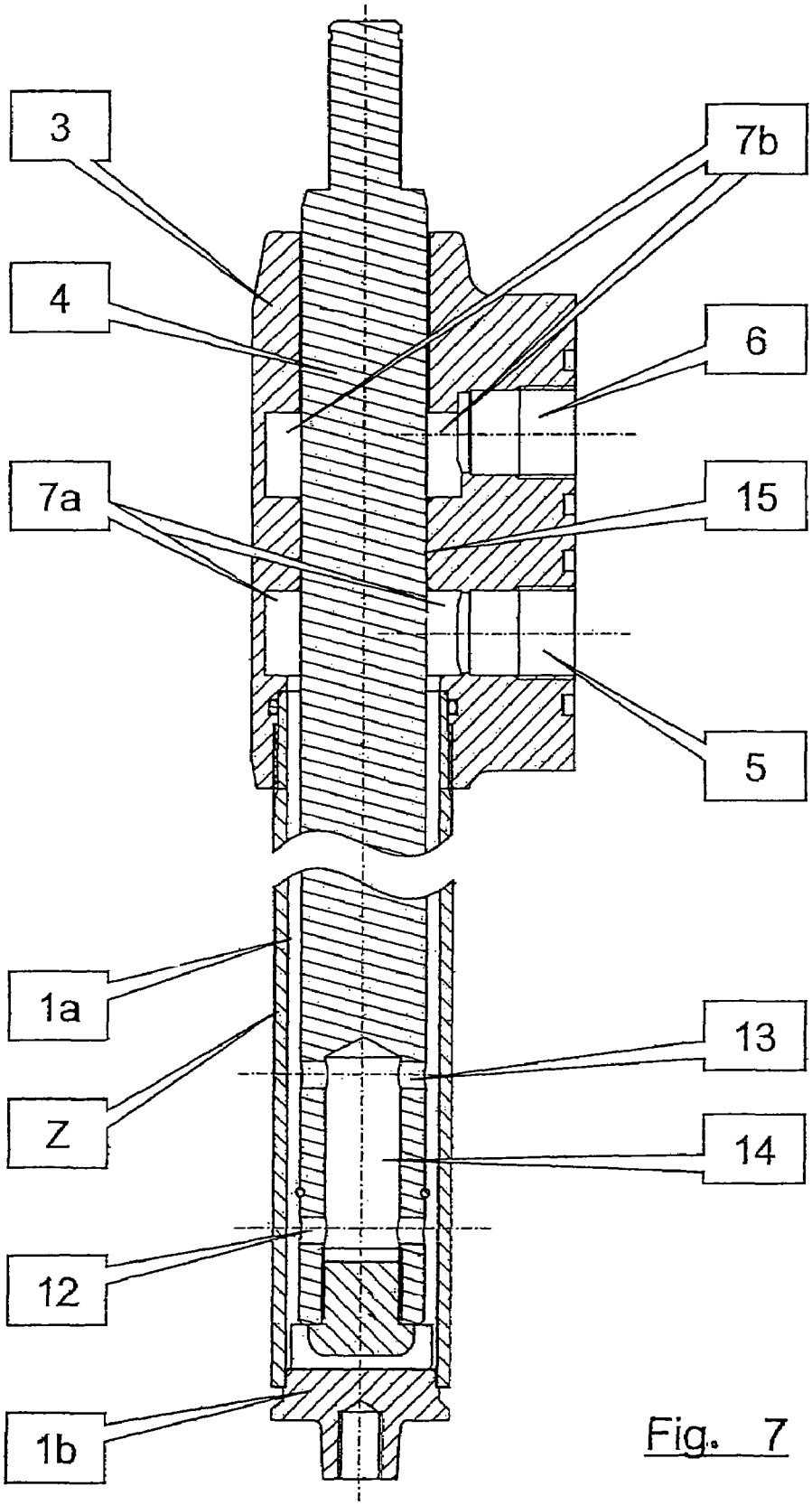
FIG. 7 is a section through a cylinder of an additional variant of a device of the invention.

In the variant illustrated in FIG. 7, which also has a head-side feed of hydraulic fluid, the sleeve-shaped pilot valve 8 and the compression spring 9 have been eliminated to simplify the construction. Instead, lower and upper radial borings 12, 13 are provided in the piston rod 4, which radial borings 12, 13 are in communication with each other through an axial boring 14. The lower radial borings 12 are always in communication with the compression chamber 1*a*, regardless of the position of the piston rod 4. The upper radial borings 13 correspond, in terms of function, to the transverse borings 10 of the pilot valve 8 in the variant illustrated in FIGS. 2 to 6.

The hydraulic fluid is supplied through an inlet opening 5 integrated into the cylinder head 3 but which, in contrast to the arrangement illustrated in FIG. 3, is below the outlet opening 6. The outlet opening 6 is thereby located in the area of the cylinder head that guides the piston rod 4. As long as the piston rod 4 is retracted or not completely extended, the outlet opening 6 seals a seat 15 machined between the piston rod 4 and the cylinder head 3.

Figure 8:
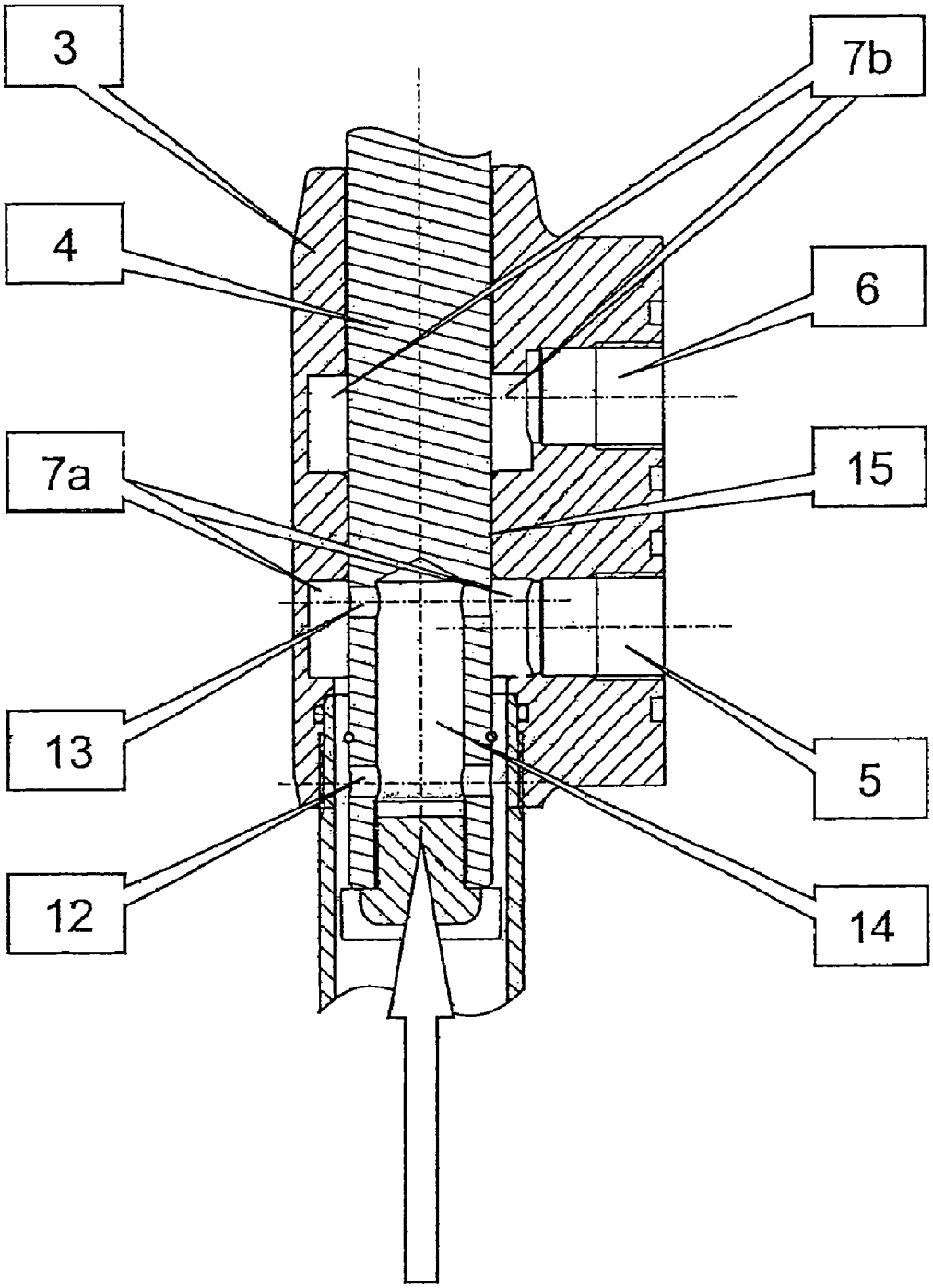
FIG. 8 shows the cylinder in FIG. 7 during the extension of the piston rod.
Figure 9:
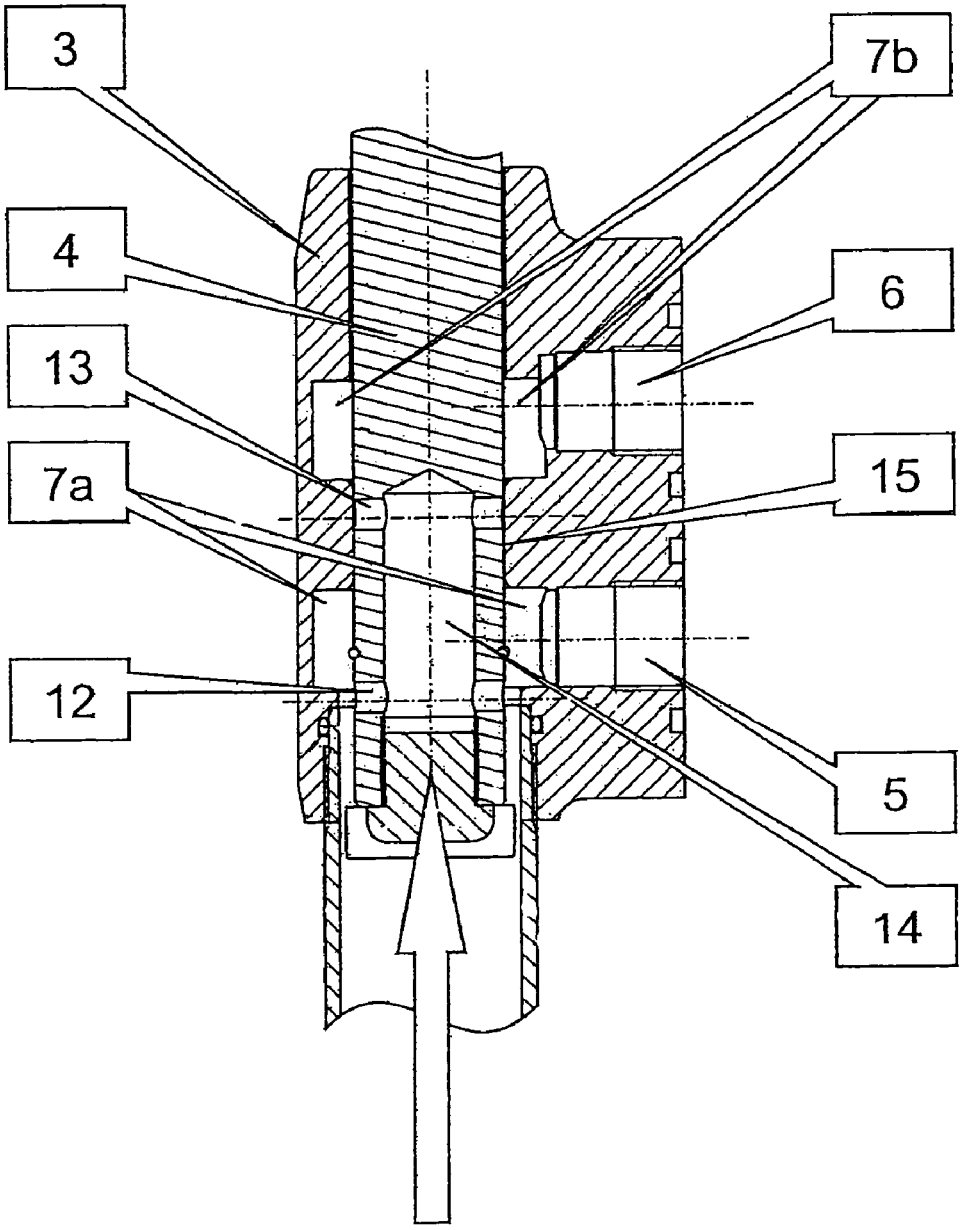
FIG. 9 shows the cylinder in FIG. 7 during the extension of the piston rod shortly before it reaches the open position of the directional control valve.

The hydraulic fluid that is under pressure and flows in through the inlet opening 5 and an annular passage 7*a* into the compression chamber 1*a* causes the piston rod 4 to be extended from the cylinder Z (see FIG. 8). The upper radial borings 13 are initially below an annular passage 7*b* (FIGS. 8 and 9) that act as a control opening and are connected to the outlet opening 6.

Figure 10:
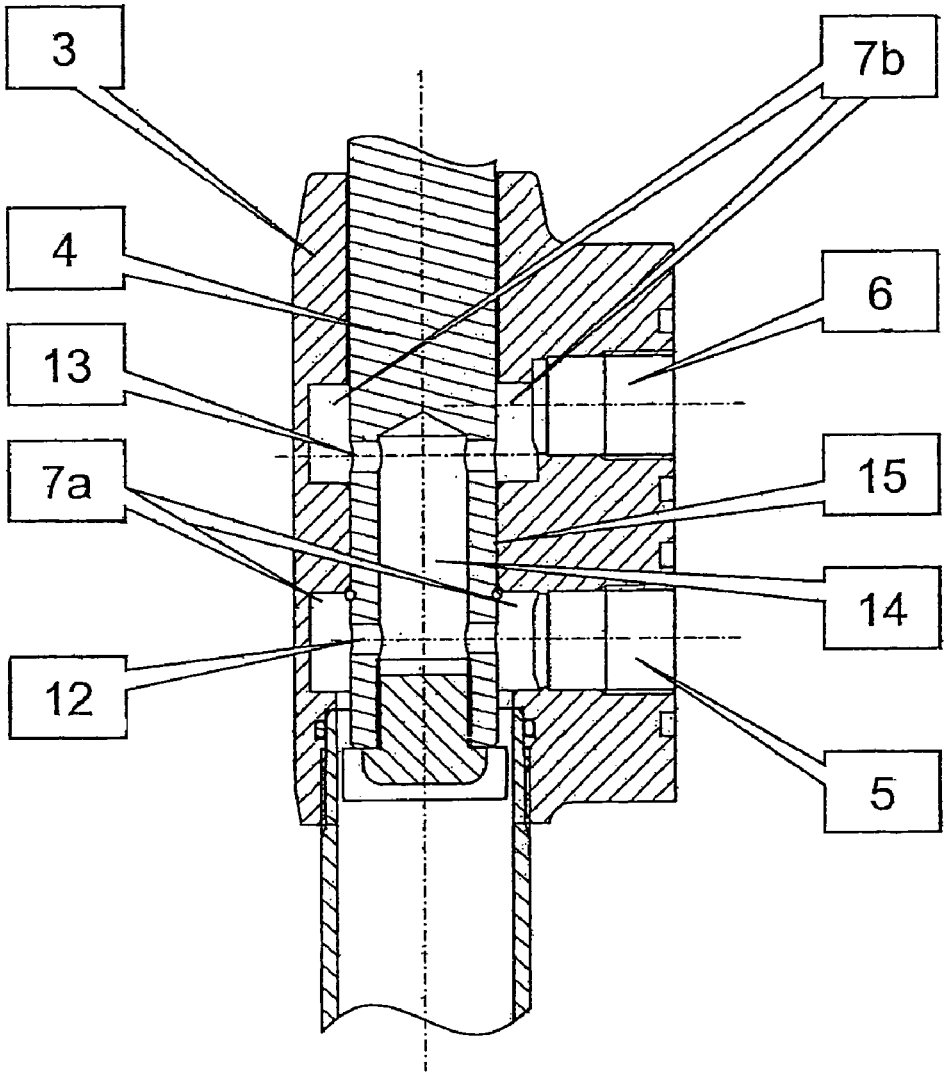
FIG. 10 shows the cylinder in FIG. 7 with the piston rod fully extended.

As the piston rod 4 is extended farther (see FIG. 10), the upper radial borings 13 reach the upper annular passage 7*b*. As a result of which, hydraulic fluid can flow into the outlet opening 6. Under these operating conditions, hydraulic fluid flows from the outlet opening 6 into the lower radial borings 12, then through the axial boring 14 to the upper radial borings 13, and from there via the upper annular passage 7*b* into the outlet opening 6. The secondary cylinder 2*b* is thereby supplied with hydraulic fluid and can extend its piston rod. In this case, the upper radial borings 13 act as control passages that are machined into the piston rod, and the upper annular passage 7*b* acts as a control opening which interacts with the control passages.

Figure 11:
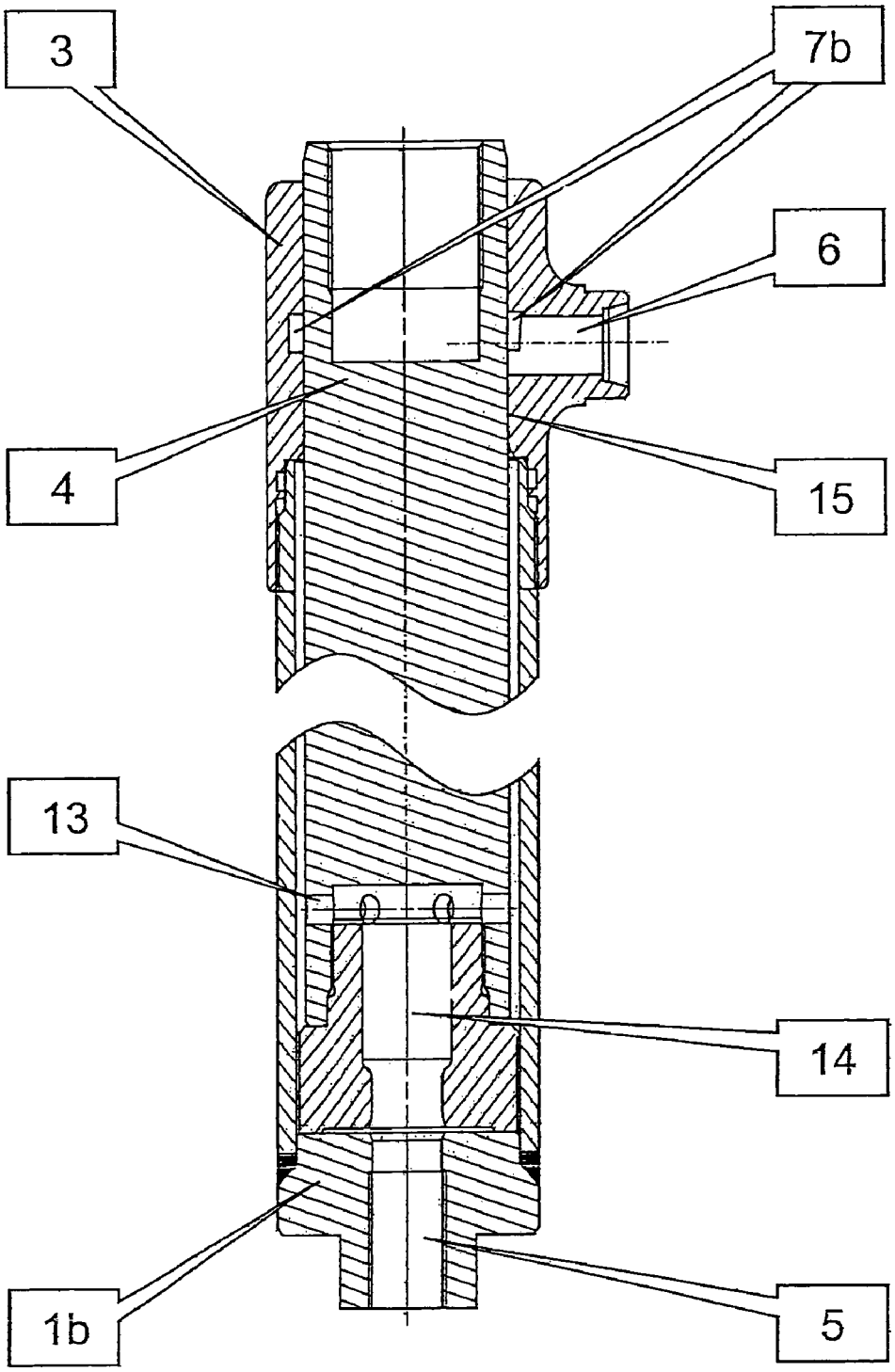
FIG. 11 is a section through a cylinder of a third variant of a device of the invention.

In the variant of the device illustrated in FIG. 11, the inlet opening 5 is located in the cylinder bottom 1*b*. The lower radial borings 12 in the piston rod 4 are omitted, along with the annular passage 7*a* that is present when the inlet opening 5 is integrated into the cylinder head 3. The hydraulic fluid flows from the inlet opening 5 into the compression chamber 1*a* and into the axial boring 14 of the piston rod 4. When the piston rod 4 is extended, shortly before it reaches its fully extended position, communication is created between the compression chamber 1*a* and the annular passage 7*a* that acts as the control opening, and, thus, the path to the secondary cylinder 2*b* is opened.

Figure 12:
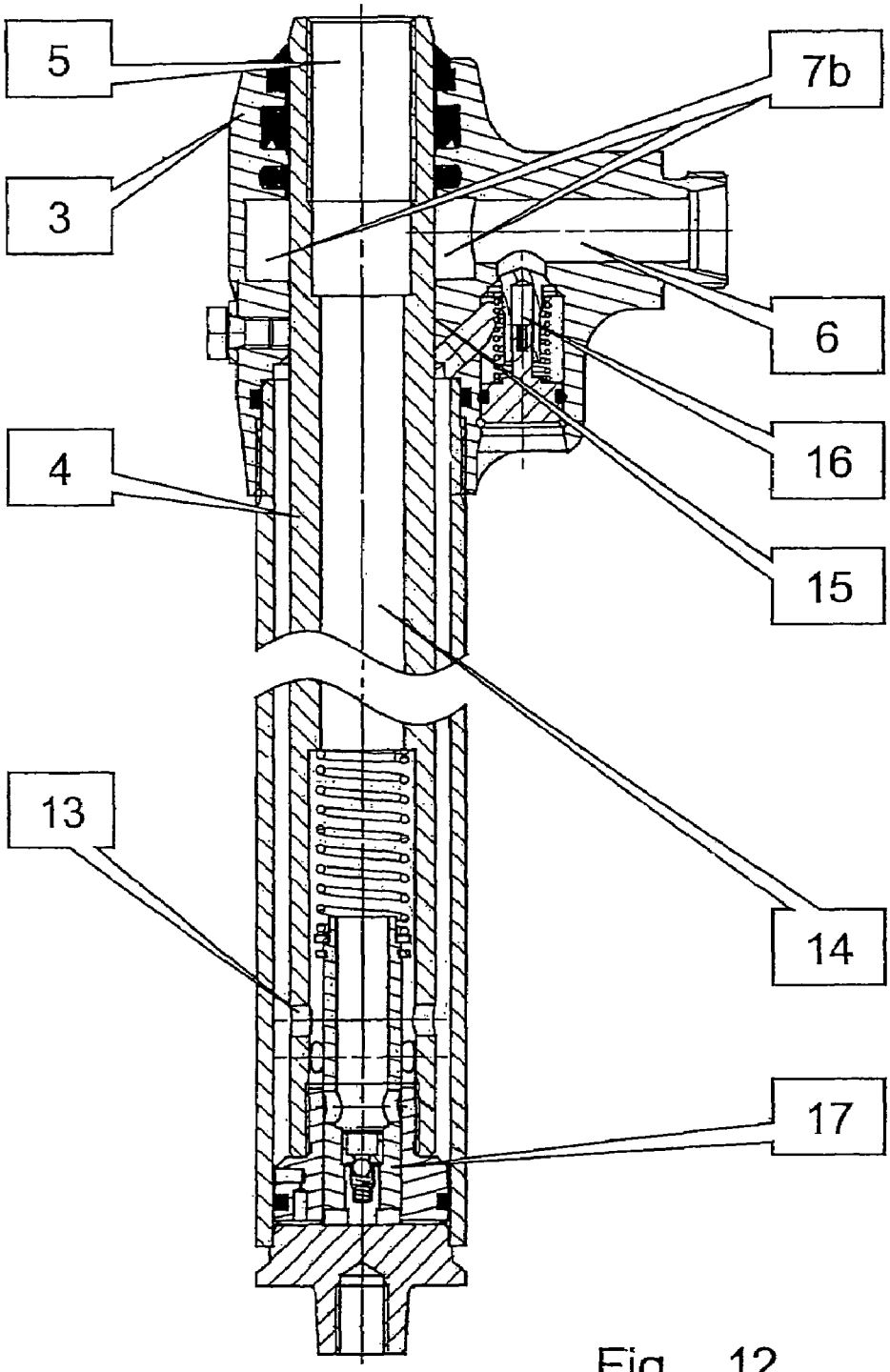
FIG. 12 is a section through a cylinder of a fourth variant of a device of the invention.

The object of FIG. 12 is an additional variant of the invention. In this case, several additional functions are integrated into the cylinder Z. The cylinder Z is further realized in the form of a cylinder that is filled by the piston rod. The inlet opening 5 is thereby located in the end of the piston rod 4 farther from the cylinder and is in communication with the compression chamber 1*a* via the axial boring 14 and the control passages.

A bypass valve 16 is provided for the bypass of the control opening (e.g., upper annular passage 7*b*) so that an undisturbed return flow of the hydraulic fluid from the secondary cylinder 2*b* is guaranteed in every position of the piston rod 4. The bypass valve 16 is realized in the form of a check valve connected in parallel to the directional control valve, although it closes in the direction of flow from the compression chamber 1*a* of the cylinder Z to the secondary cylinder 2*b* and opens only in the opposite direction of the flow.

A damping element 17 is also provided in the terminal position and is active during the retraction of the piston rod.

Figure 1:
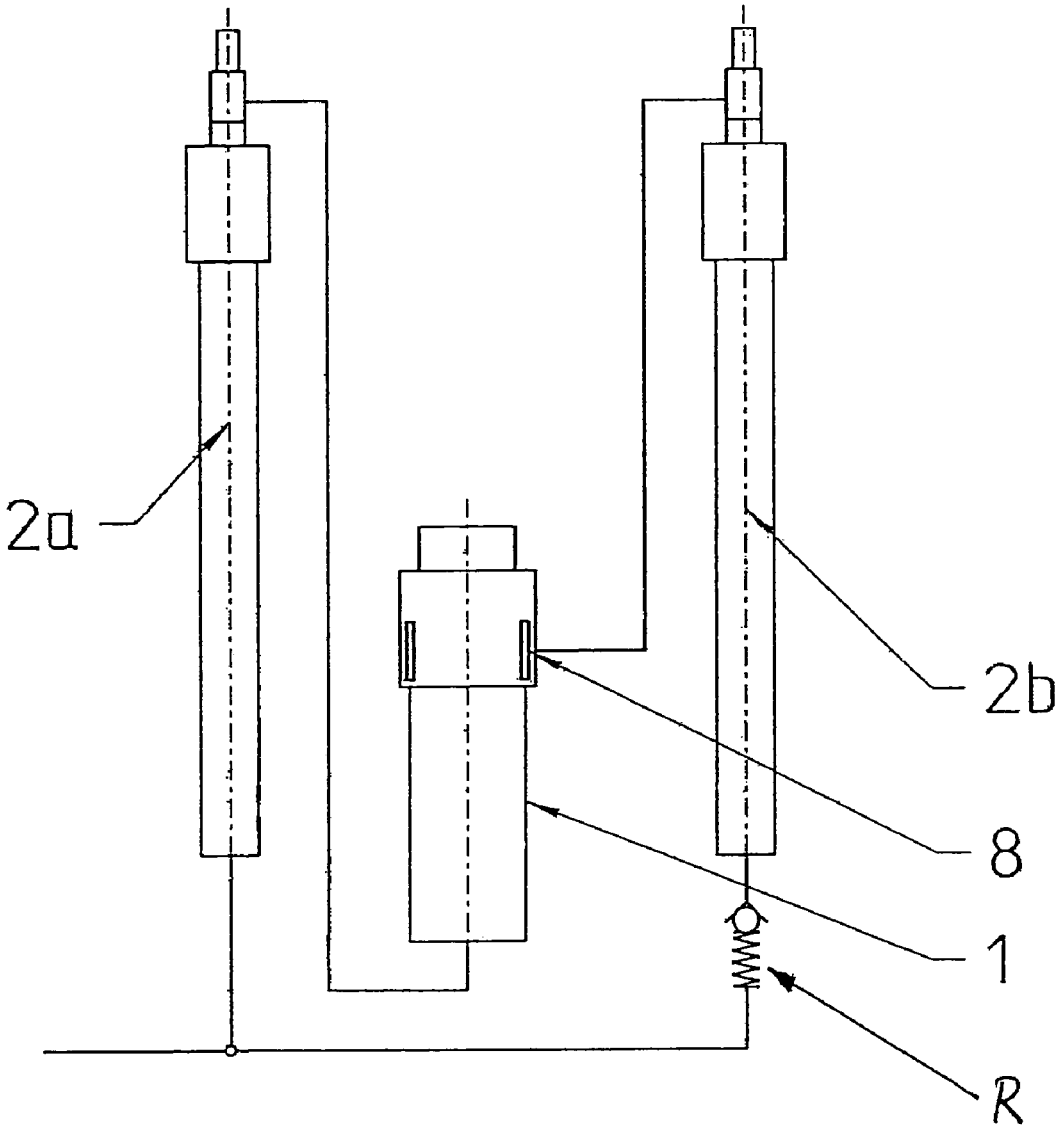
FIG. 1 is a schematic diagram of a lifting frame with a primary cylinder and two secondary cylinders.

In all of the variants described above, the device of the invention to guarantee the sequence of movement ensures that only when the piston rod 4 is extended fully or approximately fully from the cylinder Z is communication established between the compression chamber 1*a* of this cylinder Z, which acts as the primary cylinder 1, and the secondary cylinder 2*b* (see FIG. 1). If this is not the case, the secondary cylinder 2*b* remains locked.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A device to provide sequential movement of fluid-actuated displacement units, comprising:

a primary displacement unit;

a first secondary displacement unit spaced from the primary displacement unit;

a second secondary displacement unit spaced from the first secondary displacement unit, wherein for extension of the device, hydraulic fluid flows from the first secondary displacement unit, to the primary displacement unit, and then to the second secondary displacement unit, wherein the primary displacement unit is moveable chronologically before the secondary displacement units, wherein the primary displacement unit comprises a primary cylinder with a retractable and extendable primary piston rod and a control valve integrated into the cylinder, the control valve being controlled by the piston rod and having a closed position and an open position, wherein the directional control valve is switched into the closed position when the piston rod is not fully extended or substantially not fully extended, and into the open position when the piston rod is fully or substantially fully extended, such that a primary compression chamber of the primary cylinder is selectively placed in communication with a compression chamber of the second secondary displacement unit, wherein a hydraulic inlet opening for the primary cylinder is in communication with radial borings in the piston rod via an axial boring, and wherein the radial borings the control valve is in the open position when align with an annular passage connected to an outlet opening when the primary piston rod is fully extended or substantially fully extended.

2. The device as claimed in claim 1, wherein the primary cylinder has a cylinder head that guides the piston rod, and wherein the outlet opening is located in the vicinity of the cylinder head.

3. The device as claimed in claim 1, wherein between a compression chamber of the primary displacement unit and a compression chamber of the second secondary displacement unit, a bypass valve is connected which is in the form of a check valve that is parallel to the control valve and opens to the compression chamber of the primary displacement unit.

4. The device as claimed in claim 3, wherein the bypass valve is integrated into a cylinder head of the primary cylinder.

* * * * *

UNITED STATES PATENT AND TRADEMARK OFFICE

CERTIFICATE OF CORRECTION

PATENT NO. : 7,669,514 B2
APPLICATION NO. : 11/591182
DATED : March 2, 2010
INVENTOR(S) : Urbanczyk It is certified that error appears in the above-identified patent and that said Letters Patent is hereby corrected as shown below:

Column 6, Line 53, Claim 1, "wherein the directional control" should read
-- wherein the control --

Column 6, Lines 64-66, Claim 1, "wherein the radial borings the control valve is in the open position when align" should read
-- wherein the control valve is in the open position when the radial borings align --

Signed and Sealed this

Third Day of August, 2010

David J. Kappos

David J. Kappos
*Director of the United States Patent and Trademark Office*